US011091310B2

(12) United States Patent
Meaux et al.

(10) Patent No.: US 11,091,310 B2
(45) Date of Patent: Aug. 17, 2021

(54) INSULATED CONTAINER WITH TAMPER-EVIDENT, REMOVABLE, AND RESEALABLE LID

(71) Applicant: WAITR, Inc., Lake Charles, LA (US)

(72) Inventors: Chris Meaux, Lake Charles, LA (US); Robert D. Miller, Lafayette, LA (US)

(73) Assignee: WAITR, Inc., Lake Charles, LA (US)

( * ) Notice: Subject to any disclaimer, the term of this patent is extended or adjusted under 35 U.S.C. 154(b) by 194 days.

(21) Appl. No.: 15/940,472

(22) Filed: Mar. 29, 2018

(65) Prior Publication Data

US 2018/0282051 A1 Oct. 4, 2018

Related U.S. Application Data

(60) Provisional application No. 62/478,388, filed on Mar. 29, 2017.

(51) Int. Cl.
*B65D 81/38* (2006.01)
*B65D 43/02* (2006.01)
(Continued)

(52) U.S. Cl.
CPC ..... *B65D 81/3869* (2013.01); *B65D 43/0283* (2013.01); *B65D 47/06* (2013.01);
(Continued)

(58) Field of Classification Search
CPC ..... B65D 2101/00; B65D 2101/003; B65D 2231/022; B65D 2543/00046; B65D 2543/00092; B65D 2543/00231; B65D 2543/00296; B65D 2543/00518; B65D 2543/00555; B65D 2543/00953; B65D 41/32; B65D 47/06; B65D 47/089; B65D 47/36; B65D 55/0827; B65D 81/3806;
(Continued)

(56) References Cited

U.S. PATENT DOCUMENTS 3,171,580 A * 3/1965 Davis ..... B65D 17/401 229/404
6,976,578 B1 * 12/2005 Kenihan ..... B65D 51/2835 206/219
(Continued)

OTHER PUBLICATIONS

Provisional Application Cover Sheet and Specification for provisional application entitled "Insulated Container with Tamper-Evident, Removable, and Resealable Lid," by Chris Meaux, et al., filed Mar. 29, 2017 as U.S. Appl. No. 62/478,388.

*Primary Examiner* — James N Smalley
*Assistant Examiner* — Madison L Poos
(74) *Attorney, Agent, or Firm* — Barnes & Thornburg LLP

(57) ABSTRACT

Embodiments of the disclosure include an insulated drinking vessel comprising an inner wall surrounding an interior for containing a liquid beverage and an outer wall spaced from the inner wall to form an air space which acts to insulate the vessel interior in order to maintain the temperature of the liquid beverage contents within a desired range throughout a period of time which is normally required to consume the entire beverage contents. The insulated drinking vessel also includes a removable/resealable lid comprising at least one integrated tamper-evident sealed content dispensing opening which, when breached, allows the beverage contents to be removed while the lid remains attached to the vessel.

20 Claims, 6 Drawing Sheets

(51) Int. Cl.
*B65D 47/08* (2006.01)
*B65D 47/06* (2006.01)

(52) U.S. Cl.
CPC ..... *B65D 47/089* (2013.01); *B65D 81/3837* (2013.01); *B65D 2231/022* (2013.01); *B65D 2543/00046* (2013.01); *B65D 2543/00092* (2013.01); *B65D 2543/00231* (2013.01); *B65D 2543/00296* (2013.01); *B65D 2543/00518* (2013.01); *B65D 2543/00555* (2013.01); *B65D 2543/00953* (2013.01)

(58) Field of Classification Search
CPC ..... B65D 81/3837; B65D 81/3869; B65D 81/3883
USPC ..... 220/592.16, 592.17
See application file for complete search history.

(56) References Cited

U.S. PATENT DOCUMENTS

| | | | | |
|---|---|---|---|---|
| 9,254,063 | B2 * | 2/2016 | Libourel | A47J 41/02 |
| 2008/0142469 | A1 * | 6/2008 | Zeligson | B65D 41/32 215/217 |
| 2009/0266828 | A1 * | 10/2009 | Cai | B65D 43/0212 220/712 |
| 2012/0037669 | A1 * | 2/2012 | Goetz | A47G 19/34 222/456 |
| 2016/0001933 | A1 * | 1/2016 | Roth | B65D 47/286 220/254.5 |
| 2016/0007783 | A1 * | 1/2016 | Melton | A47G 19/2288 220/592.17 |

* cited by examiner

INSULATED CONTAINER WITH TAMPER-EVIDENT, REMOVABLE, AND RESEALABLE LID

CROSS-REFERENCE TO RELATED APPLICATIONS

This application is a continuation of and claims priority to U.S. Provisional Application No. 62/478,388 entitled "Insulated Container with Tamper-Evident, Removable/Resealable Lid" and filed Mar. 29, 2017, which is incorporated herein by reference in its entirety.

BACKGROUND

This disclosure relates to an insulated container and, more particularly, to an insulated drinking vessel having a double wall insulated construction and a tamper-evident removable/resealable lid with at least one integrated tamper-evident sealed content dispensing opening. Insulated drinking vessels are well known in the art. Moreover, drinking vessels having a double wall structure with an insulating void between the walls are well known. Notwithstanding, there remains a longstanding and unfilled need for an insulated drinking vessel having an inner wall, an outer wall spaced from the inner wall to form an insulating void between the walls, and a tamper-evident removable/resealable lid having an integrated tamper-evident sealed content dispensing opening, thereby providing a spill proof drinking vessel which maintains the temperature of the liquid beverage contents within a desired range for an extended period of time and which can also demonstrate that the contents of the container have not been altered since the tamper-evident removable/resealable lid was affixed to the body of the drinking vessel.

In particular, there remains an urgent need for a double wall insulating structure with a removable/resealable tamper-evident lid having an integrated tamper-evident sealed content dispensing opening for use in the food delivery service industry to allow customers to order desired beverages for delivery and have said beverages delivered for consumption with the desired temperature profile while also demonstrating that the beverages have not been altered or tampered with after the beverages were placed into the drinking vessel and said drinking vessel's tamper-evident removable/resealable lid was attached to the drinking vessel.

SUMMARY

In an embodiment of the disclosure, an insulated drinking vessel may comprise a double wall construction; and a tamper-evident lid having at least one integrated tamper-evident sealed content dispensing opening.

In another embodiment of the disclosure, a method may comprise providing an insulated drinking vessel with a tamper-evident lid, wherein the insulated drinking vessel comprises a double wall construction; wherein the tamper-evident lid is configured to engage with a rim of the insulated drinking vessel; and wherein the tamper-evident lid comprises at least one integrated tamper-evident sealed content dispensing opening.

In yet another embodiment of the disclosure, an insulated drinking vessel may comprise an inner wall configured to contain a liquid; an outer wall spaced from the inner wall to create a void between the inner and outer walls, wherein the inner wall and the outer wall join at a rim of the insulated drinking vessel; and a tamper-evident lid configured to attach to the rim of the insulated drinking vessel, comprising at least one integrated tamper-evident sealed content dispensing opening.

BRIEF DESCRIPTION OF THE DRAWINGS

For a fuller understanding of the nature of the present disclosure, reference should be made to the following detailed description taken in conjunction with the accompanying drawings.

Like reference numerals refer to like parts throughout the several views of the drawings.

DETAILED DESCRIPTION

Unless defined otherwise, technical and scientific terms used herein have the same meaning as commonly understood by one of ordinary skill in the art to which the claimed material belongs. The following terms are defined below.

Embodiments of the disclosure include an insulated drinking vessel which comprises an inner wall surrounding (and defining) an interior for containing a liquid beverage and an outer wall spaced from the inner wall to form a space or void which acts to insulate the vessel interior in order to maintain the temperature of the liquid beverage contents within a desired range throughout a period of time required to consume the beverage contents. Embodiments of the disclosure may also include a tamper-evident removable/resealable lid for covering the open top of the vessel. The tamper-evident lid includes at least one integrated tamper-evident sealed content dispensing opening which, when breached, allows the beverage contents to be removed while the lid remains attached to the vessel. The lid further serves to prevent accidental spillage of the beverage contents. In some embodiments, the outer wall may be transparent or translucent allowing for the inner wall to be visible. In some embodiments, the outer wall may be transparent or translucent and the inner wall may be transparent or translucent, allowing for the beverage contained within the inner wall to be visible.

It is an object of the present disclosure to provide an insulated drinking vessel for beverages, wherein the vessel is provided with a double wall construction and a tamper-evident removable/resealable lid having at least one integrated tamper-evident sealed content dispensing opening.

Figure 1:
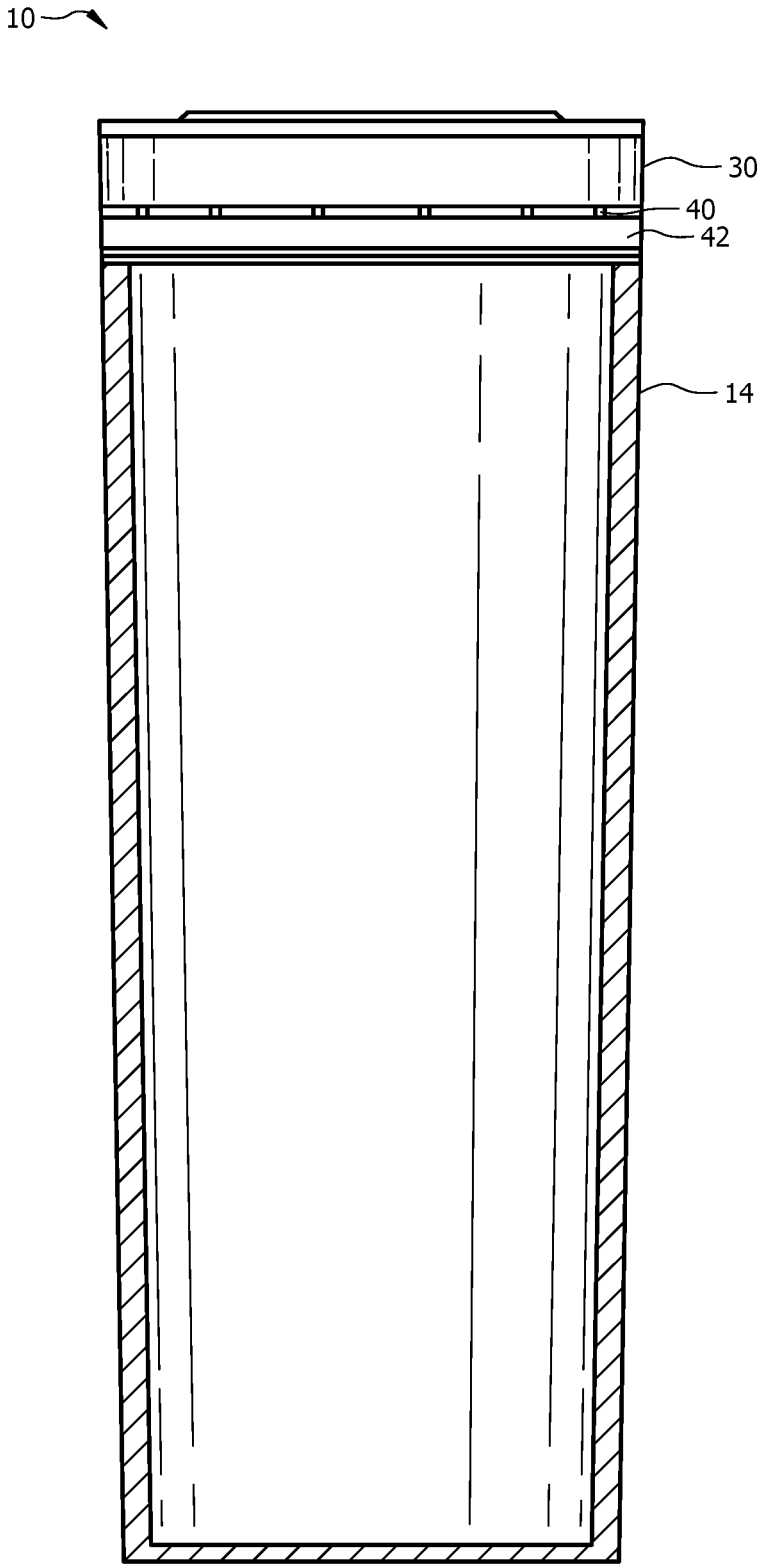
FIG. 1 is a view of the insulated drinking vessel according to an embodiment of the disclosure.
Figure 2:
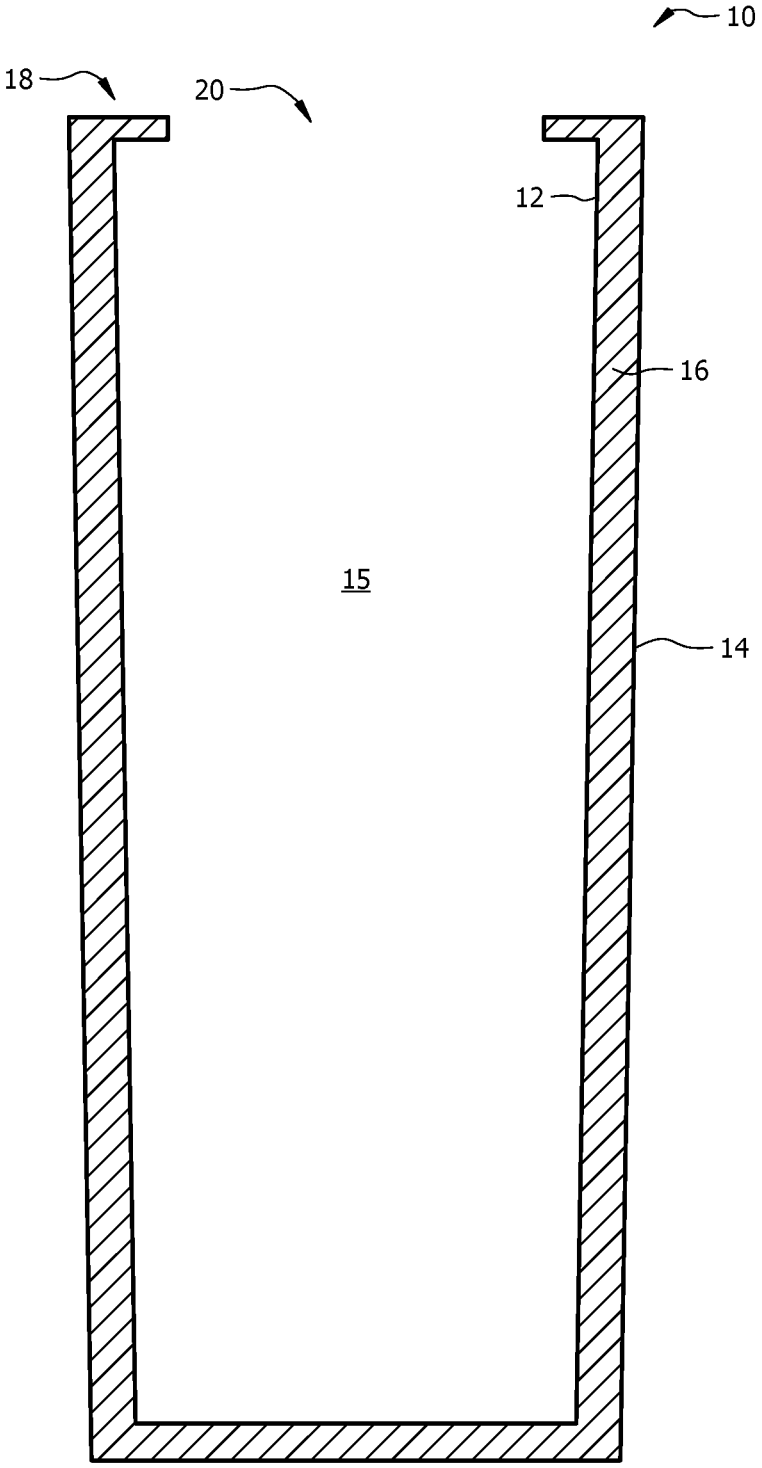
FIG. 2 is a view, in cross-section, of the insulated drinking vessel as depicted in FIG. 1 (without the removable/resealable lid), according to an embodiment of the disclosure.

FIGS. 1 and 2 illustrate an embodiment of a drinking vessel 10. FIG. 1 shows the vessel 10 with a tamper-evident removable/resealable lid 30 (also referred to as lid 30 or tamper-evident lid 30)) attached, and FIG. 2 shows a cross-section of the vessel 10 without the lid 30. In this particular embodiment, the drinking vessel 10 is in the form of a tumbler or highball drinking glass. The drinking vessel 10 may comprise an insulated wall structure including an inner wall 12 and an outer wall 14. The inner wall 12 surrounds and defines an interior 15 of the drinking vessel which is structured and configured to contain a liquid beverage therein. The outer wall 14 is spaced from the inner wall 12 to provide a gap or void 16 between the inner and outer walls. The inner wall 12 and outer wall 14 are joined at an upper end to form a rim 18 surrounding an opening 20 communicating with the vessel interior 15. In an embodiment, both the inner wall 12 and outer wall 14 are formed of a transparent material. In an embodiment, the drinking vessel 10 may be shaped and dimensioned to be secured within a drink holder of a user's automobile.

The tamper-evident lid 30 may attach to the vessel 10 via a tamper-evident band 42 and a tamper bead 40, which are described in more detail below. The tamper-evident band 42 may be directly attached to and/or incorporated into the inner wall 12 and/or outer wall 14 of the vessel 10. In some embodiments, the lid 30 may also comprise a threaded portion 50 (shown in FIG. 6) positioned above the tamper bead 40 configured to thread onto and/or off of the vessel 10.

Figure 3:
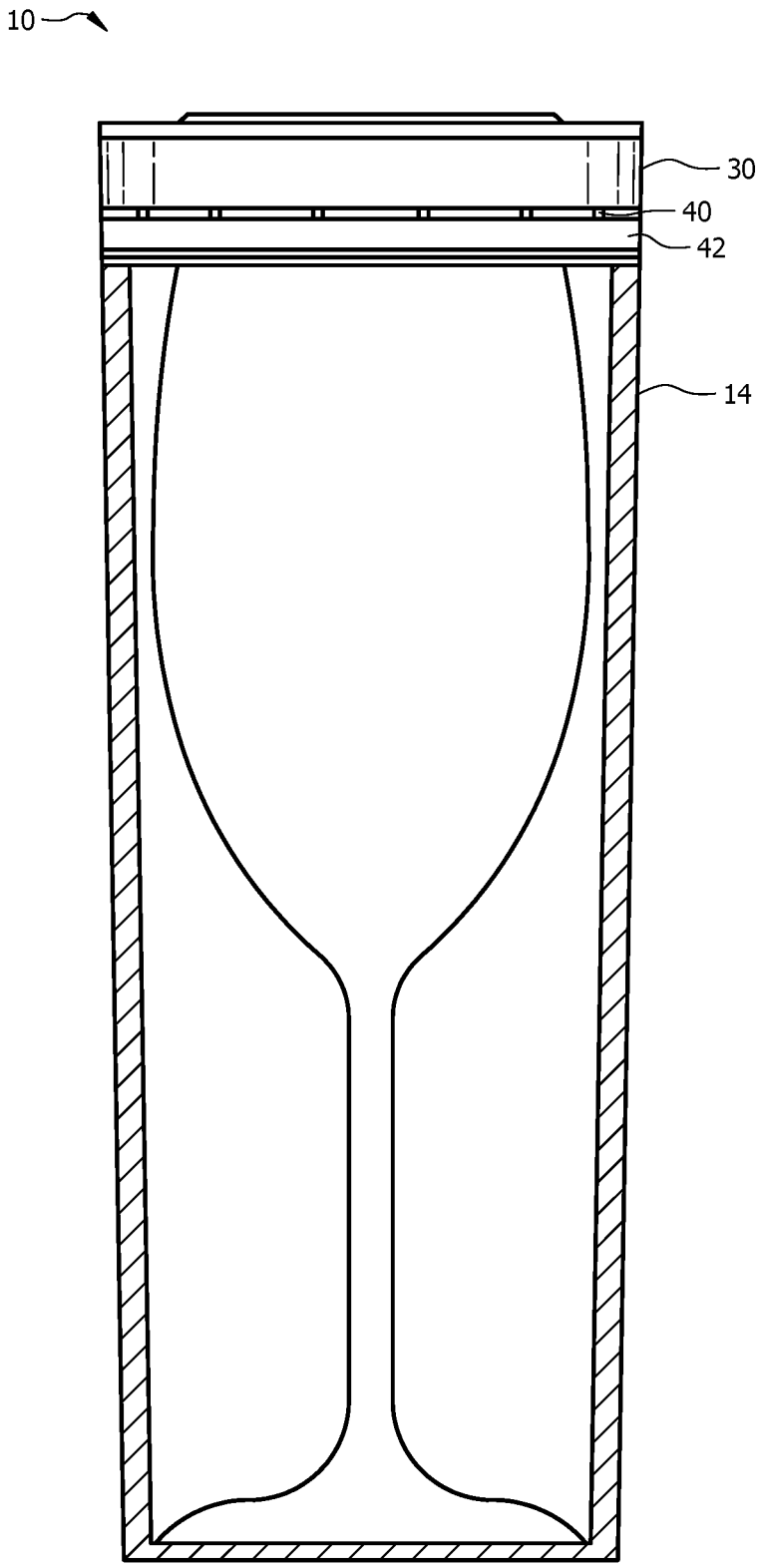
FIG. 3 is a view of the insulated drinking vessel according to an embodiment of the disclosure.
Figure 4:
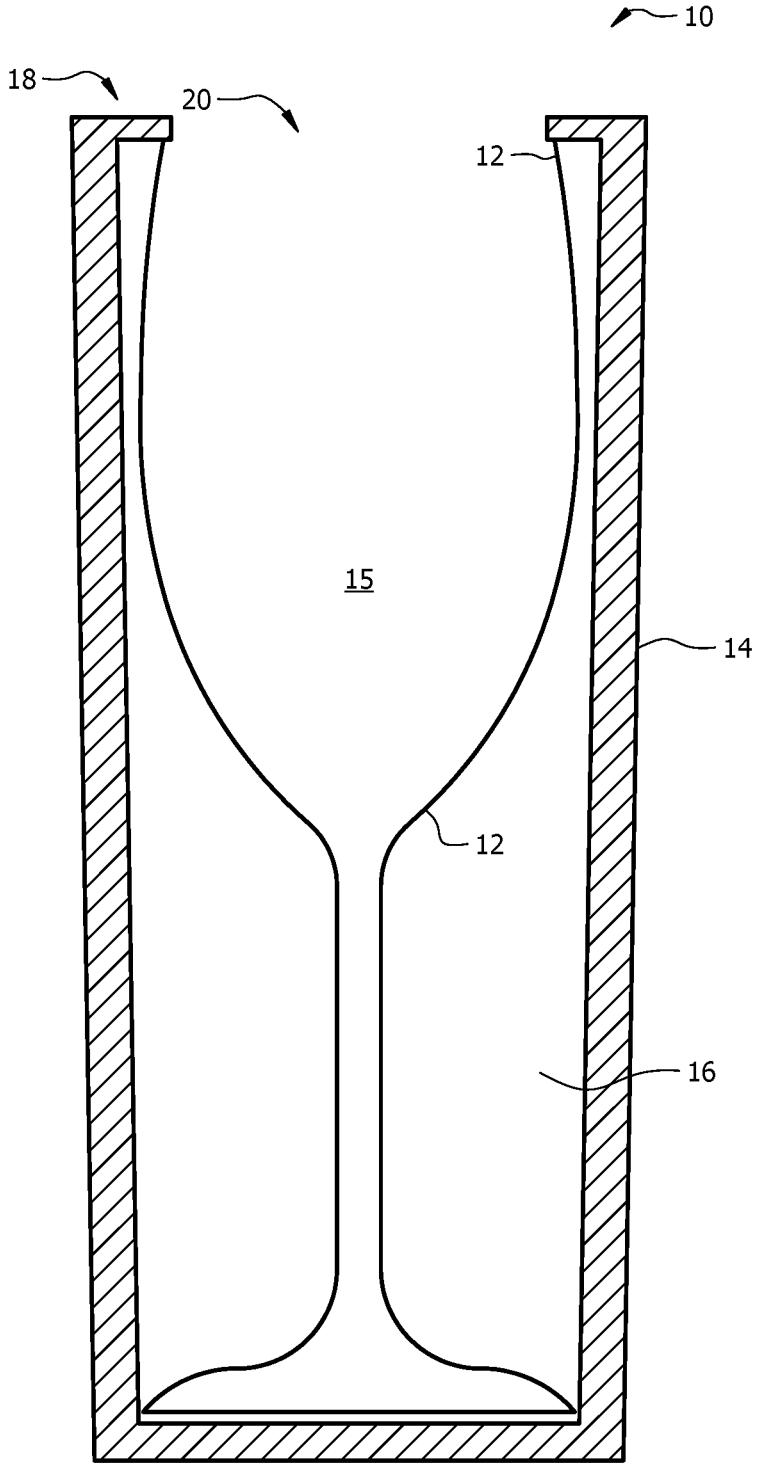
FIG. 4 is a view, in cross-section, of the insulated drinking vessel as depicted in FIG. 3 (without the removable/resealable lid), according to an embodiment of the disclosure.

In an embodiment, as shown in FIGS. 3 and 4, the interior 15 (as may be defined by inner wall 12) may comprise any of a plurality of shapes and volumes, e.g., different cup/container shapes for containing a liquid beverage disposed therein. For example, the different cup/container shapes may resemble a goblet, a chalice, a pint glass, a weizen glass, a snifter, a tulip glass, a thistle glass, a stange glass, and a wine glass (e.g., standard, flute, coupe, hock, and tumbler). Those of ordinary skill in the art can readily select the shape of the cup/container appropriate for the instant beverage. In an embodiment, the outer wall 14 may be shaped the same or different from the inner wall 12.

In an embodiment, the drinking vessel 10, e.g., the outer wall 14, the inner wall 12, the lid 30, or combinations thereof, may comprise information, markings, designs, data, or combinations thereof. The information, markings, designs, data, or combinations thereof may be used by the drinking vessel provider, receiver, deliverer, or combinations thereof.

Referring to FIGS. 1, 3, 5A, and 5B, a tamper-evident removable/resealable lid 30 is configured to cover the opening 20 of the drinking vessel 10 (as shown above). The tamper-evident removable/resealable lid 30 may comprise any type of tamper-evident closure as known in the art, e.g., a closure which features a tear away tamper-evident band 42 that may detach from the remainder of the closure as the closure is turned.

In at least one embodiment, the tamper-evident removable/resealable lid 30 comprises at least one integrated tamper-evident sealed content dispensing opening 31 which, when breached, allows the beverage contents to be removed from the drinking vessel while the lid remains attached to the vessel. The tamper-evident sealed content dispensing opening 31 may be sealed with foil, thin plastic, plastic lined foil, a heat shrink band, or combinations thereof.

In an embodiment the tamper-evident removable/resealable lid 30 may comprise three sealed content dispensing openings 31, 32, and 33, wherein opening 31 is larger than openings 32 and 33 and better suited for direct dispensing of the drinking vessel's contents and wherein openings 32 and 33 are smaller than opening 31 and better suited for allowing a straw to be introduced into the drinking vessel for removal of the drinking vessel's contents. The integrated tamper-evident sealed content dispensing openings 31, 32, and 33 may, when breached, allow the beverage contents to be removed from the drinking vessel while the lid remains attached to the vessel. The tamper-evident sealed content dispensing openings 31, 32, and 33 may be sealed with foil, thin plastic, plastic lined foil, a heat shrink band, or combinations thereof.

Figure 5A:
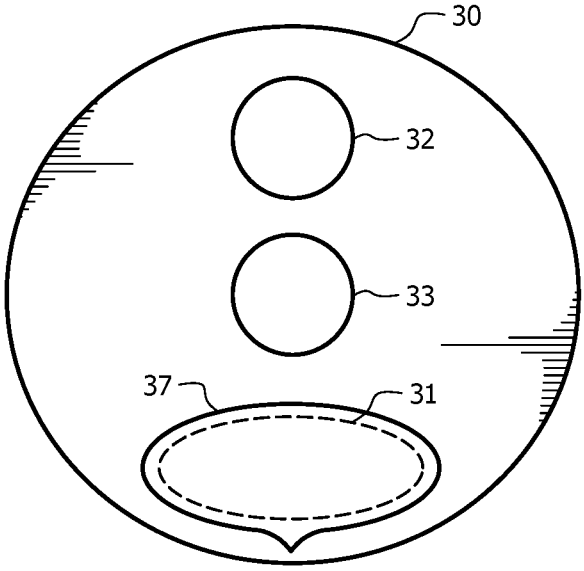
FIG. 5A is a cross-sectional view of the removable/resealable lid according to an embodiment of the disclosure.
Figure 5B:
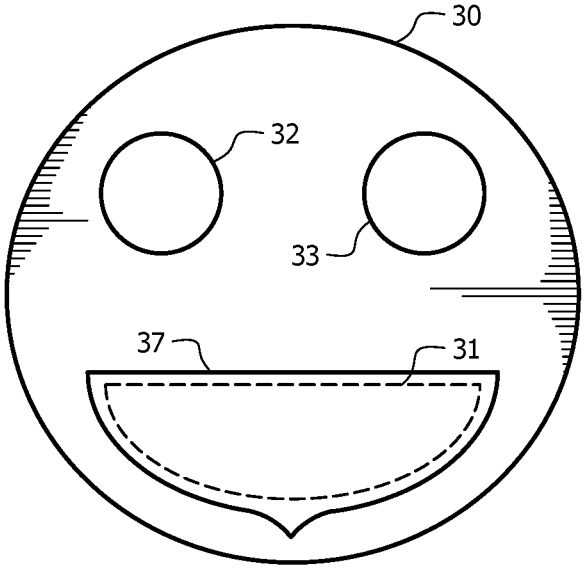
FIG. 5B is a cross-sectional view of the removable/resealable lid according to an embodiment of the disclosure.

FIGS. 5A and 5B illustrate different arrangements of the dispensing openings 31, 32, and 33 with respect to one another. In some embodiments, the tamper-evident lid 30 may also comprise a tear-away tab 37, which may be attached over (or under) at least one of the openings 31, 32, and 33 (and possibly concealing the opening(s) 31, 32, and 33). In some embodiments, at least one of the openings 31, 32, and 33 may comprise a puncturable and/or sealing boundary, wherein the boundaries may be breached by a straw and/or other device. In some embodiments, a combination of different seals and/or tabs may be used to cover the openings 31, 32, and 33, while in other embodiments, the openings 31, 32, and 33 may all comprise the same type of seal and/or tab.

Figure 6:
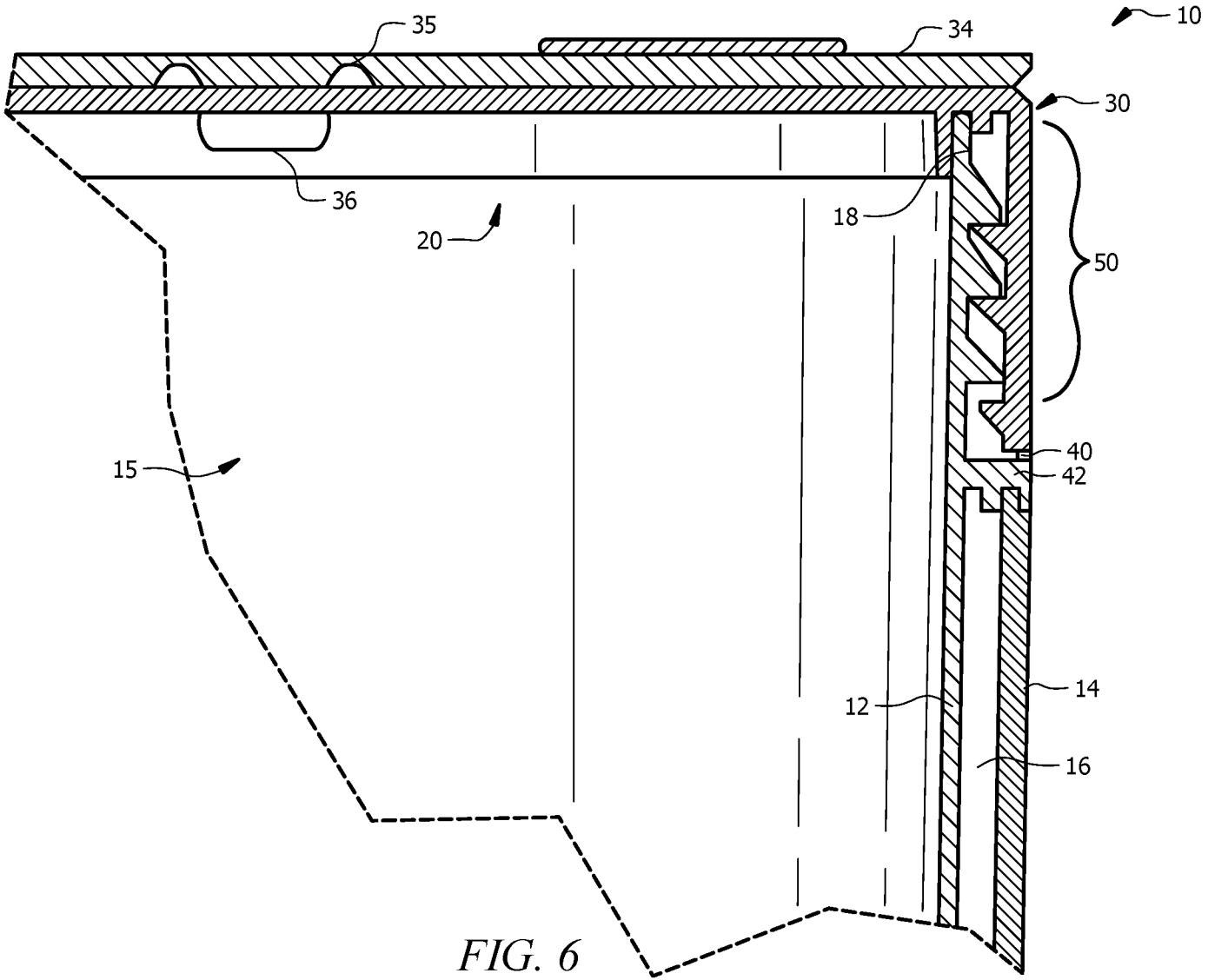
FIG. 6 is a different cross-sectional view, in cut-away, of the removable/resealable lid of the insulated drinking vessel comprising actuatable flaps which may be actuated to allow or restrict access to the drinking vessel's openings for fluid transfer, according to an embodiment of the disclosure.

Referring to FIG. 6, a cross-sectional view of the lid 30 and drinking vessel 10 are shown. In an embodiment, use of the tear away type of closure typically features the molding of a tamper bead 40 directly onto the outer wall 14 of the drinking vessel 10 and also providing for threaded engagement of the closure (e.g., tamper-evident lid 30) with the outer wall 14 of drinking vessel 10 via threaded portion 50 of the lid 30. The tamper bead 40 on the outer wall 14 will "catch" the tamper-evident band 42, causing it to break away from the rest of the closure (or lid 30). Once the band 42 has been broken, it separates from the remainder of the closure (or lid 30), making it obvious that the tamper-evident lid 30 has been previously opened.

In an embodiment, the tamper-evident removable/resealable lid 30 is configured to "snap" fit onto the rim 18 surrounding the opening 20 communicating with the vessel interior 15 and the tamper-evident lid 30 comprises a tear-way tab portion affixed to the bottom of the lid 30 (not shown) configured to separate from the lid 30 which allows the lid 30 to be "unsnapped" and removed from the rim 18. Those of ordinary skill in the art will understand this snap fit tear away tab to be akin to tear away tabs present on milk containers comprising snap off lids.

In some embodiments, the tamper-evident removable/resealable lid 30 comprises at least one actuatable flap 34 which can be actuated to allow or restrict access to at least one of the dispensing openings 31, 32, and 33 (shown in FIGS. 5A-5B). In an embodiment, the actuatable flap 34 may be permanently attached to the tamper-evident removable/resealable lid 30. In an embodiment, the actuatable flap 34 may be releasably attachable and detachable to the tamper-evident removable/resealable lid 30. In an embodiment, the actuatable flap 34 may be secured to the tamper-evident removable/resealable lid 30 via a releasably locking/coupling mechanism. In an embodiment, the releasably locking/coupling mechanism may comprise a snap-like arrangement of a protrusion and/or indentation 36, an adhesive, a hook and loop component, an aperture and pin/rivet arrangement, or combinations thereof.

In an embodiment, the actuatable flap 34 may be actuated on a movable joint or mechanism to allow or restrict access to at least one of the dispensing openings 31, 32, and 33. In an embodiment, the actuatable flap may rotate about an axis defined by living hinge 35. In an embodiment, the actuatable flap 34 may be secured in a position restricting access to at least one of the dispensing openings 31, 32, and 33 via a releasably locking mechanism. In an embodiment, the actuatable flap 34 may be secured in a position restricting access to at least one of the dispensing openings 31, 32, and 33 via a releasably locking/coupling mechanism. In an embodiment, the releasably locking/coupling mechanism may comprise a snap-like arrangement of a protrusion and indentation, an adhesive, a hook and loop component, an aperture and pin/rivet arrangement, and/or combinations thereof.

The components of the drinking vessel described herein, e.g., the inner wall, outer wall, and lid, may be made of any suitable material, e.g., a polyolefin, e.g., polypropylene or polyethylene, in copolymer or homopolymeric form, or combinations thereof. Additionally, engineering resins can be employed, such as, e.g., acrylonitrile/butadiene/styrene, polycarbonates, styrene acrylonitrile, or combinations thereof. Those of ordinary skill in the art can readily select a suitable material, without undue experimentation, from well-known commercial sources.

While the present disclosure has been shown and described in accordance with several embodiments thereof, it is recognized that departures from the instant disclosure are contemplated within the spirit and scope of the present disclosure which, therefore, should not be limited except as set forth in the following claims as interpreted under the doctrine of equivalents.

Having described various devices and methods herein, exemplary embodiments or aspects can include, but are not limited to:

In a first embodiment, an insulated drinking vessel may comprise a double wall construction; and a tamper-evident lid having at least one integrated tamper-evident sealed content dispensing opening.

A second embodiment can include the insulated drinking vessel of the first embodiment, wherein the double wall construction comprises an inner wall and an outer wall.

A third embodiment can include the insulated drinking vessel of the second embodiment, wherein the inner wall comprises one or more of the following shapes: a goblet, a chalice, a pint glass, a weizen glass, a snifter, a tulip glass, a thistle glass, a stange glass, and a wine glass (e.g., standard, flute, coupe, hock, and tumbler).

A fourth embodiment can include the insulated drinking vessel of the second or third embodiment, wherein one or both of the inner wall and the outer wall are formed of a transparent material.

A fifth embodiment can include the insulated drinking vessel of any of the second through fourth embodiments, wherein the inner wall is spaced from the outer wall to create a void between the inner and outer walls.

A sixth embodiment can include the insulated drinking vessel of any of the second through fifth embodiments, wherein the outer wall is shaped and dimensioned to be secured within a drink holder of a user's automobile.

A seventh embodiment can include the insulated drinking vessel of any of the first through sixth embodiments, wherein the tamper-evident lid comprises a plurality of integrated tamper-evident sealed content dispensing openings.

An eighth embodiment can include the insulated drinking vessel of the seventh embodiment, wherein a first opening is suited for direct dispensing of the drinking vessel's contents and wherein a second opening is suited for allowing a straw to be introduced into the drinking vessel for removal of the drinking vessel's contents.

A ninth embodiment can include the insulated drinking vessel of any of the first through eighth embodiments, wherein the tamper-evident lid is configured to engage with a tamper bead and tamper-evident band molded onto a wall of the drinking vessel.

A tenth embodiment can include the insulated drinking vessel of the ninth embodiment, wherein the tamper bead is configured to tear away from the tamper-evident band when the tamper-evident lid is removed from the drinking vessel.

An eleventh embodiment can include the insulated drinking vessel of any of the first through tenth embodiments, wherein the tamper-evident lid comprises a tamper-evident band configured to break away upon opening of the tamper-evident lid.

A twelfth embodiment can include the insulated drinking vessel of any of the first through eleventh embodiments, wherein the tamper-evident lid comprises at least one actuatable flap configured to be actuated to allow or restrict access to the at least one dispensing opening.

A thirteenth embodiment can include the insulated drinking vessel of any of the first through twelfth embodiments, wherein the at least one actuatable flap is configured to be actuated about a hinge.

In a fourteenth embodiment, a method may comprise providing an insulated drinking vessel with a tamper-evident lid, wherein the insulated drinking vessel comprises a double wall construction; wherein the tamper-evident lid is configured to engage with a rim of the insulated drinking vessel; and wherein the tamper-evident lid comprises at least one integrated tamper-evident sealed content dispensing opening.

A fifteenth embodiment can include the method of the fourteenth embodiment, wherein the tamper-evident lid is configured to engage with a tamper bead of the insulated drinking vessel.

A sixteenth embodiment can include the method of the fourteenth embodiment, further comprising attaching the tamper-evident lid to the insulated drinking vessel.

A seventeenth embodiment can include the method of the sixteenth embodiment, wherein attaching the tamper-evident lid to the insulated drinking vessel comprises engaging the tamper-evident lid with a tamper bead of the insulated drinking vessel.

An eighteenth embodiment can include the method of the sixteenth or seventeenth embodiment, wherein the tamper-evident lid comprises a plurality of integrated tamper-evident sealed content dispensing openings.

A nineteenth embodiment can include the method of the eighteenth embodiment, wherein a first opening is suited for direct dispensing of the drinking vessel's contents and wherein a second opening is suited for allowing a straw to be introduced into the drinking vessel for removal of the drinking vessel's contents.

In a twentieth embodiment, an insulated drinking vessel may comprise an inner wall configured to contain a liquid; an outer wall spaced from the inner wall to create a void between the inner and outer walls, wherein the inner wall and the outer wall join at a rim of the insulated drinking vessel; and a tamper-evident lid configured to attach to the rim of the insulated drinking vessel, comprising at least one integrated tamper-evident sealed content dispensing opening.

What is claimed is:

1. An insulated drinking vessel comprising:

a double wall construction; and a tamper-evident lid having a plurality of integrated tamper-evident sealed content dispensing openings, wherein the tamper-evident lid is made of a first material, wherein the tamper-evident lid is configured to engage with a tamper bead and tamper-evident band molded onto a wall of the drinking vessel, wherein the integrated tamper-evident sealed content dispensing openings are sealed with a second material, and wherein contents of the insulated drinking vessel may be removed via the plurality of integrated tamper-evident sealed content dispensing openings.

2. The insulated drinking vessel of claim 1, wherein the double wall construction comprises an inner wall and an outer wall.

3. The insulated drinking vessel of claim 2, wherein the inner wall comprises one or more of the following shapes: a goblet, a chalice, a pint glass, a weizen glass, a snifter, a tulip glass, a thistle glass, a stange glass, and a wine glass (e.g., standard, flute, coupe, hock, and tumbler).

4. The insulated drinking vessel of claim 2, wherein one or both of the inner wall and the outer wall are formed of a transparent material.

5. The insulated drinking vessel of claim 2, wherein the inner wall is spaced from the outer wall to create a void between the inner and outer walls.

6. The insulated drinking vessel of claim 2, wherein the outer wall is shaped and dimensioned to be secured within a drink holder of a user's automobile.

7. The insulated drinking vessel of claim 1, wherein a first opening is suited for direct dispensing of the drinking vessel's contents and wherein a second opening is suited for allowing a straw to be introduced into the drinking vessel for removal of the drinking vessel's contents.

8. The insulated drinking vessel of claim 1, wherein the tamper bead is configured to tear away from the tamper-evident band when the tamper-evident lid is removed from the drinking vessel.

9. The insulated drinking vessel of claim 1, wherein the tamper-evident lid comprises at least one actuatable flap configured to be actuated to allow or restrict access to the at least one dispensing opening.

10. The insulated drinking vessel of claim 9, wherein the at least one actuatable flap is configured to be actuated about a hinge.

11. The insulated drinking vessel of claim 1, wherein the second material comprises foil, thin plastic, plastic lined foil, a heat shrink band, or combinations thereof.

12. An insulated drinking vessel comprising:

a double wall construction; and a tamper-evident lid having a plurality of integrated tamper-evident sealed content dispensing openings, wherein the tamper-evident lid is made of a first material, wherein the tamper-evident lid comprises a tamper-evident band configured to break away upon opening of the tamper-evident lid, wherein the integrated tamper-evident sealed content dispensing openings are sealed with a second material, and wherein contents of the insulated drinking vessel may be removed via the plurality of integrated tamper-evident content dispensing openings.

13. The insulated drinking vessel of claim 12, wherein the second material comprises foil, thin plastic, plastic lined foil, a heat shrink band, or combinations thereof.

14. A method for providing an insulated drinking vessel with a tamper-evident lid, wherein the insulated drinking vessel comprises a double wall construction;

wherein the tamper-evident lid is configured to engage with a rim of the insulated drinking vessel and wherein the tamper-evident lid is configured to engage with a tamper bead of the insulated drinking vessel; and wherein the tamper-evident lid comprises a plurality of integrated tamper-evident sealed content dispensing openings, wherein the tamper-evident lid is made of a first material, wherein the integrated tamper-evident sealed content dispensing openings are sealed with a second material, and wherein contents of the insulated drinking vessel may be removed via the plurality of integrated tamper-evident sealed content dispensing openings.

15. The method of claim 14, further comprising attaching the tamper-evident lid to the insulated drinking vessel.

16. The method of claim 15, wherein attaching the tamper-evident lid to the insulated drinking vessel comprises engaging the tamper-evident lid with the tamper bead of the insulated drinking vessel.

17. The method of claim 14, wherein a first opening is suited for direct dispensing of the drinking vessel's contents and wherein a second opening is suited for allowing a straw to be introduced into the drinking vessel for removal of the drinking vessel's contents.

18. The method for providing an insulated drinking vessel with a tamper-evident lid of claim 14, wherein the second material comprises foil, thin plastic, plastic lined foil, a heat shrink band, or combinations thereof.

19. The method of claim 14, wherein the tamper-evident lid comprises at least one actuatable flap configured to be actuated to allow or restrict access to the at least one dispensing opening.

20. The method of claim 19, wherein the at least one actuatable flap is configured to be actuated about a hinge.

* * * * *